166-66 SR
M7219 XR 4,267,885

United States Patent [19]

Sanderford

[11] 4,267,885

[45] May 19, 1981

[54] METHOD AND APPARATUS FOR OPTIMIZING PRODUCTION IN A CONTINUOUS OR INTERMITTENT GAS-LIFT WELL

[75] Inventor: Dorsey W. Sanderford, Lake Charles, La.

[73] Assignee: Cybar, Inc., Calcasieu Parish, La.

[21] Appl. No.: 62,798

[22] Filed: Aug. 1, 1979

[51] Int. Cl.[3] ..... E21B 43/12

[52] U.S. Cl. ..... 166/250; 166/53; 166/64; 166/314; 166/65 R; 417/54

[58] Field of Search ..... 166/53, 64, 65 R, 66, 166/68, 105.6, 105, 314, 250; 417/54, 55, 108, 109, 111, 292

[56] References Cited

U.S. PATENT DOCUMENTS

| | | | |
|---|---|---|---|
| 1,907,608 | 5/1933 | Subkow | 417/54 |
| 2,188,656 | 1/1940 | Guiberson | 417/109 |
| 2,951,451 | 9/1960 | Vincent | 417/54 |
| 3,090,316 | 5/1963 | Montgomery . | |
| 3,343,598 | 9/1967 | Meldan et al. | 166/64 X |
| 3,357,490 | 12/1967 | Holmes | 166/53 |
| 3,377,532 | 4/1968 | Lane et al. | 417/109 X |
| 3,457,993 | 7/1969 | Parker et al. | 166/64 X |
| 3,873,238 | 3/1975 | Elfarr | 417/54 |
| 3,892,270 | 7/1975 | Lindquist | 166/251 |
| 4,150,721 | 4/1979 | Norwood | 166/314 X |

FOREIGN PATENT DOCUMENTS

| | | | |
|---|---|---|---|
| 324350 | 2/1972 | U.S.S.R. | 166/64 |

OTHER PUBLICATIONS

Brown, *Gas Lift Theory and Practice,* Published by Prentice-Hall, Inc., Englewood Cliffs, N.J., p. 115.

*Primary Examiner*—Stephen J. Novosad
*Attorney, Agent, or Firm*—Fleit & Jacobson

[57] ABSTRACT

A method and apparatus to optimize and control the production of an oil well which is being artificially produced by gas-lift techniques. The invention is suitable for use with either continuous or intermittent gas-lift operation and can be used with a combination of both. The temperature of the fluid at the wellhead is sensed and used to determine the injection parameter values to optimize well production. In one embodiment, a process control unit is programmed according to the inventive method to interpret the temperature data and to control the gas control valve to optimize production.

16 Claims, 13 Drawing Figures

SURFACE FLOWING TEMPERATURE

SURFACE
75°F
122°F
130°F
10
12
FLOW TEMP. GRADIENT
100 BBL / DAY
125 BBL / DAY
14
16
COOLING DUE TO CONDUCTION OF HEAT INTO COOLER FORMATION
BHT = 160°F at 12,000'
20
18
DEPTH x 1000 Feet
0
1
2
3
4
5
6
7
8
9
10
11
12
13
14
15
70 80 90 100 110 120 130 140 150 160 170 180
TEMPERATURE °F BHT
28
24
30
26
LIQUID PRODUCTION
SURFACE FLOW TEMP.
TEMP. of FLUID AT SURFACE
SURFACE
Increase
FLUID PRODUCTION
0
Increase
GAS - LIQUID RATIO

METHOD AND APPARATUS FOR OPTIMIZING PRODUCTION IN A CONTINUOUS OR INTERMITTENT GAS-LIFT WELL

BACKGROUND OF THE INVENTION

The present invention relates to a method and apparatus for improving the production of an oil well.

More specifically, the present invention relates to a method and apparatus for improving the production of an oil well, which is being artificially produced by the gas-lift technique.

As is well known, the gas-lift technique is employed in wells, typically oil wells, which have difficulty in producing naturally. That is, wells in which the formation pressure is not sufficient to cause the well to produce at an acceptable volume. The gas-lift technique injects gas into the casing, which has been sealed or packed off at the bottom of the hole relative to the production tubing. A gas-lift valve is placed in the production tubing at the production level, and the gas-lift valve permits the gas to be injected into or bubble into the fluid being produced from the well. The gas passes very slowly through the gas-lift valve and bubbles into the column of fluid, which is in the producing tubing. This gas then makes the fluid in the production tube somewhat lighter and, hence, the natural formation pressure will be sufficient to push the fluid up and out of the well. This means that the well can be produced at a greater rate. The gas-lift technique described above is known as continuous gas-lift.

An adaption of this gas-lift technique is known as intermittent gas-lift. In this technique, rather than letting the gas enter the production tube slowly, the gas is injected into the production tubing very quickly, thereby forming a large slug of fluid in the production tubing above the injected gas bubble. The gas bubble then drives the slug of fluid in the production tubing upwardly. The intermittent technique is repeated successivley, thereby producing successive slugs of fluid at the wellhead.

In order to optimize production employing either of these two gas-lift methods, it is necessary to unergo trial and error operation to determine the specific parametric values relative to the gas-lift injectin. For example, in the continuous gas-lift method it is necessary to undergo a trial and error period to determine the optimum injection rate of gas into the well necessary to maximize production. Similarly, in the intermittent gas-lift method, it is necessary to determine not only the optimum gas-lift pressure to be injected into the production tubing, but also the periodicity of the discreet gas injections. As expected, in the intermittent method, if the gas is injected too frequently, the slug of fluid formed above the gas bubble will not be large enough to maximize production of the well. Similarly, if the time between successive injections is too long, valuable production time is lost. Both of these two types of gas-lift production techniques are improved by the present invention.

The existence of increased temperatues in the earth's core has been well-known for some time. Specifically, it is known that as one progresses deeper and deeper into the earth's core the temperature increases accordingly. This is termed the geothermal gradient of the earth. While the fact that the temperature increases with depth is a general rule, the extent of the gradient varies at different locations around the earth and is generally not the same for any two wells. The effect of this geothermal gradient is that the liquid being produced from reservoirs at the same depth will appear at the respective wellheads at different temperatures.

Although this geothermal gradient has been well-known and the gas-lift technique has become more and more popular, the combination of this geothermal gradient phenomenon with the gas-lift technique has not heretofore provided advantageous results. Nevertheless, there has been a correlation shown between the temperature of the fluid produced at the wellhead in a gas-injected well and the optimum rate of liquid flow. Such correlation is briefly discussed in the textbook by K. E. Brown, *Gas Lift Theory And Practice,* Prentice-Hall, Inc. At page 115, Mr. Brown shows a graph indicating the surface flowing temperature of the fluid at the wellhead plotted against the gas/liquid ratio of the gas injected system. Various curves for different production rates at the well head are shown. Nevertheless, there is no discussion of how to arrive at the optimum gas/liquid ratio.

SUMMARY OF THE INVENTION

The present invention provides a method and apparatus which eliminates the need for trial and error in a gas lift well. The present invention operates with equal efficiency on either a continuous gas-lift well or an intermittent gas-lift well. The present invention recognizes the fact that the peak wellhead temperature of the fluid being produced correlates with the optimum flow of the well. By employing a temperature transducer which senses the wellhead temperature and produces a signal, which is fed to a specially prepared microprocessor or computing unit, the amount and frequency of the gas being injected into the well may be controlled. The present invention recognizes that the temperature of the fluid at the wellhead, when plotted against the gas/liquid ratio, will reach a peak and then actually begin to decrease due to the refrigeration effects of the injected gas. Additionally, along with this peaking and roll-off of the wellhead fluid temperature, the present invention recognizes that there is a similar peak which occurs relative to the maximum production of the well. By recognizing that the peaks in these two curves occur at approximately the same point along the gas/liquid ratio line, the amount of gas injected into the well can be optimally selected. The control valve for the gas injection system is then controlled accordingly by the process computer or microprocessor provided by the present invention.

Therefore, it is an object of the present invention to optimize the production in a gas-lift oil well.

It is also an object of the present invention to provide a method and apparatus which uses a temperature transducer and surface control valve to optimize production of a gas-lift oil well.

It is another object of the present invention to provide a method for reducing the requirement for trial and error in starting production in a gas-lift assisted oil well.

The manner in which these and other objects are accomplished by the present invention will be seen more clearly from the following detailed description of the invention.

DETAILED DESCRIPTION OF THE INVENTION

Because no two oil wells are alike, it is not possible to use the actual temperature of two different wells to compare their performance. Nevertheless, you can use the actual temperature of an individual well to monitor its performance on an hourly or daily bais. The temperature of the liquid produced at the wellhead is directly related to the rate of production, and this is shown in FIG. 1.

Figure 1:
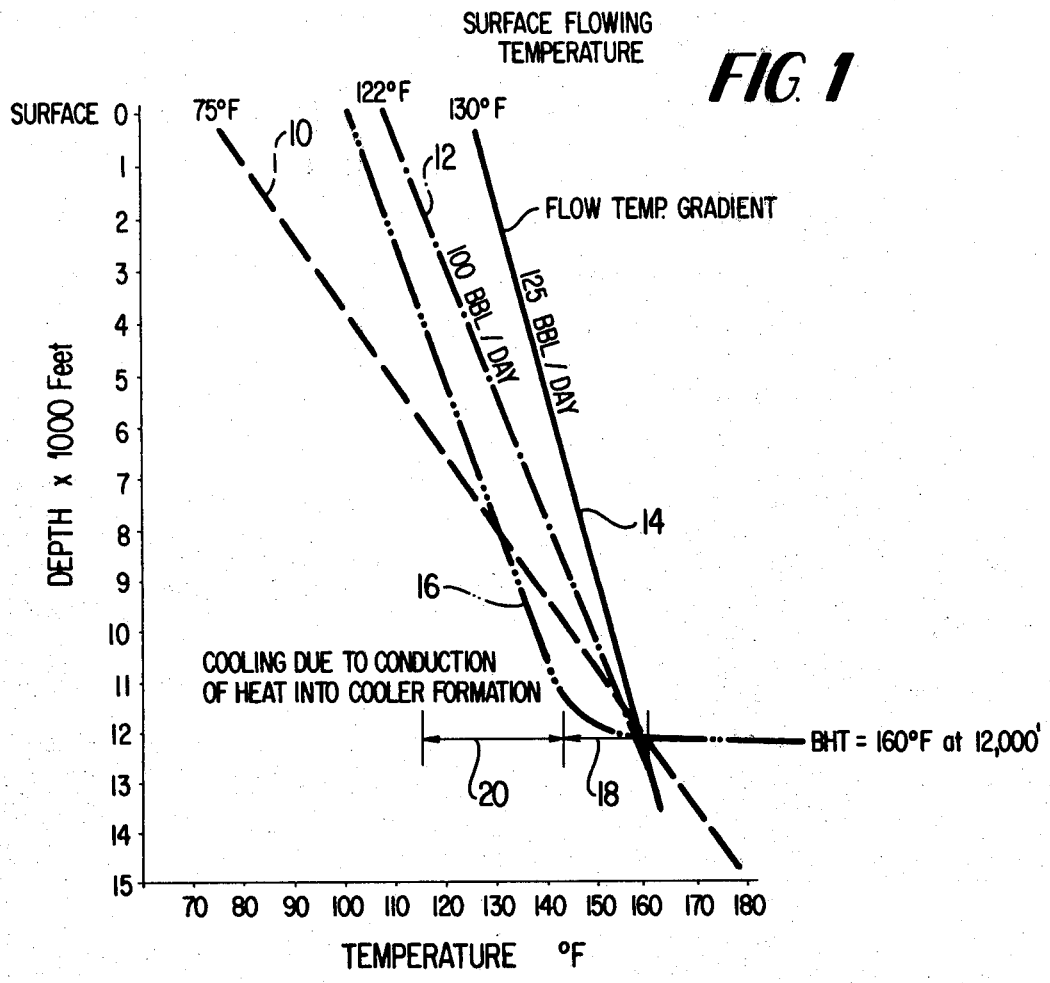
FIG. 1 is a graph showing flow temperature gradients of natural production and gas-lift production oil wells.

FIG. 1 is a plot of a well depth from the surface, in 1000 foot increments, versus temperature in degrees Fahrenheit, with ten degree increments. The geothermal gradient is shown by the dashed line at 10. As a typical example, the geothermal gradient runs from 75° at the well surface to 160° at a depth of 12,000 ft. Assuming that the well in this example is being produced naturally, i.e., without any gas-lift assistance, at a rate of 100 barrels per day, as shown by dot and dash line 12, the drop in temperature from the bottom hole temperature of 160° will be approximately 38° and the temperature of the fluid being produced at the wellhead will be about 122°. If the surface choke were adjusted and the production allowed to increase to 125 barrels per day, as shown by solid line 14, the fluid will not lose as much of its heat during the trip to the surface and the fluid flowing at the wellhead will be 130°. That is, there was a heat loss of only 30° on the trip up the hole. Accordingly, from this graph, it appears that the faster one can flow the liquid to the surface, the less heat the fluid loses and the closer the well head fluid temperature will approach the bottom hole temperature.

In the case of a gas-lift well, wherein an artificial means aids in the production of the well, the flow temperature gradient of the fluid will be altered from that of the natural flow, as shown in curves 12 and 14. In the present example, assuming again that the surface temperature is 75° and the bottom hole temperature is 160° at 12,000 feet, the temperature of the fluid in a gas-lift well may be shown by the curved line 16 shown as a dash and double dotted line. From this curve, it may be seen that when the gas is injected, there is a cooling effect, which takes place upon expansion of the gas. This cooling effect is, of course, the conventional refrigeration effect. Hence, it may be seen at the injection point on curve 16, that although the bottom hole temperature is 160°, approximately 15 degrees will be lost at the initial injection of the gas due to expansion of the gas. This is shown by the temperature span at 18. The gas then reacts quite similarly to the fluid being naturally produced and arrives at the surface with a temperature of 115°. As indicated above, this temperature drop is due to natural conduction and convection of the gas and liquid as they progress upwardly through the well. This additional 30° loss may be shown by the temperature span 20. Hence, in the present example, the production of fluid loses 45 degrees from the bottom hole temperature to the surface or wellhead temperature; 15 of these degrees were lost to cooling caused by expansion of the gas and 30 degrees were lost from conduction into the cooler formations, as the fluid and the gas progresses up the production tubing. It should be pointed out that this example of the gas-lift well relates to a continuous gas-lift well, and also that each gas-lift well will have a different flowing temperature at the surface and a different flow temperature due to the different thermal gradients. Hence, as discussed above, the amount of gas injected, the size of tubing, the depth of the well and several other factors will result in different flow temperatures of the fluid at the surface in different wells.

Figure 2:
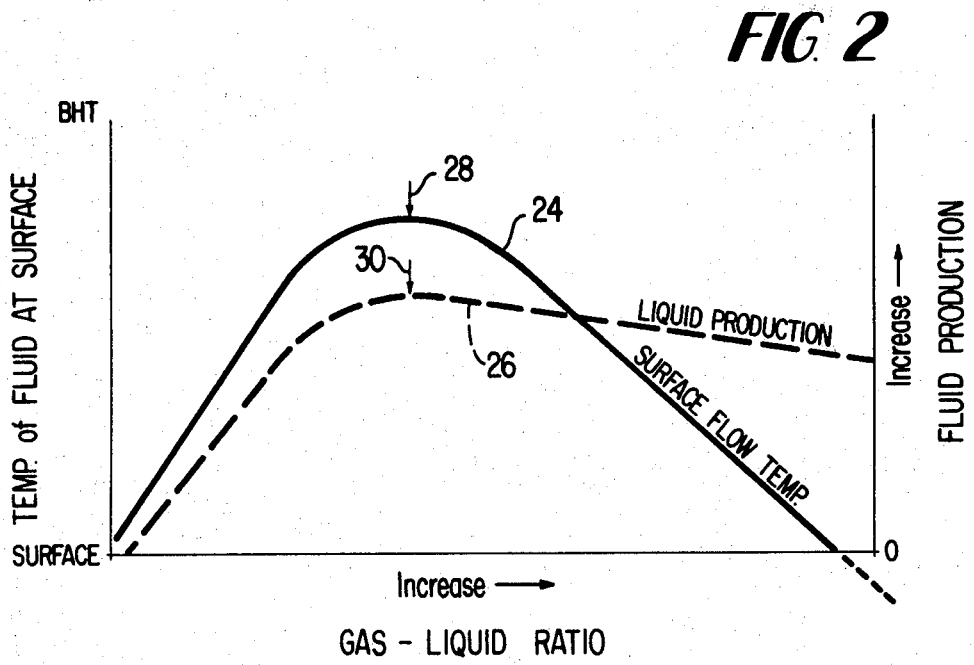
FIG. 2 is a graph of well production versus fluid flow temperature at the wellhead.

Referring now to FIG. 2, which is a graph of the temperature of the fluid at the well head versus the gas liquid ratio of a gas injected well, two curves are shown at 24 and 26, which relate the gas liquid ratio both to the flowing temperature at the surface and also to the production of the fluid at the surface. The solid line 24, which is the surface flowing temperature, indicates that the liquid temperature at the surface will reach a peak at some point along the gas liquid ratio line and will then begin roll off and decrease. This liquid temperature can actually go below the ambient surface temperature, if enough gas is injected into the well. The flowing temperature at the surface can actually be a freezing temperature, which is much cooler than the actual surface temperature. As indicated, this is because in order to produce certain wells, it is necessary to inject so much gas that a large enough refrigeration effect is produced to actually cause the fluid being produced to be below the freezing point.

Referring to the dashed line, which is the production of the fluid at the well, it is seen that it also reaches a peak and then begins to decrease only slightly. The peaks of these two curves shown by arrows 28 and 30, respectively, occur very near each other, if not exactly at the same point on the abscissa of FIG. 2, which is the gas liquid ratio. Therefore, the present invention recognizes that if one were to monitor the temperature of the liquid flowing at the well head, and then cause this temperature to reach a peak, that such peak should correlate quite closely to the maximum liquid production from the well, with the minimum amount of gas being injected into the well.

Although it is a basis of the present invention to realize the correlation between the peaks of the two curves of FIG. 2, it is not necessary to operate the production at the well at this peak. By following the present invention, it is possible to actually operate the well at any point along the curve. This may be achieved by knowing the temperature curve. Hence, it might be desirable to operate at 10% less than peak, or if fact, on the back side of the curve, where the production and the temperature both drop off. The present invention provides an apparatus and method to operate at any point along this production curve.

Figure 3:
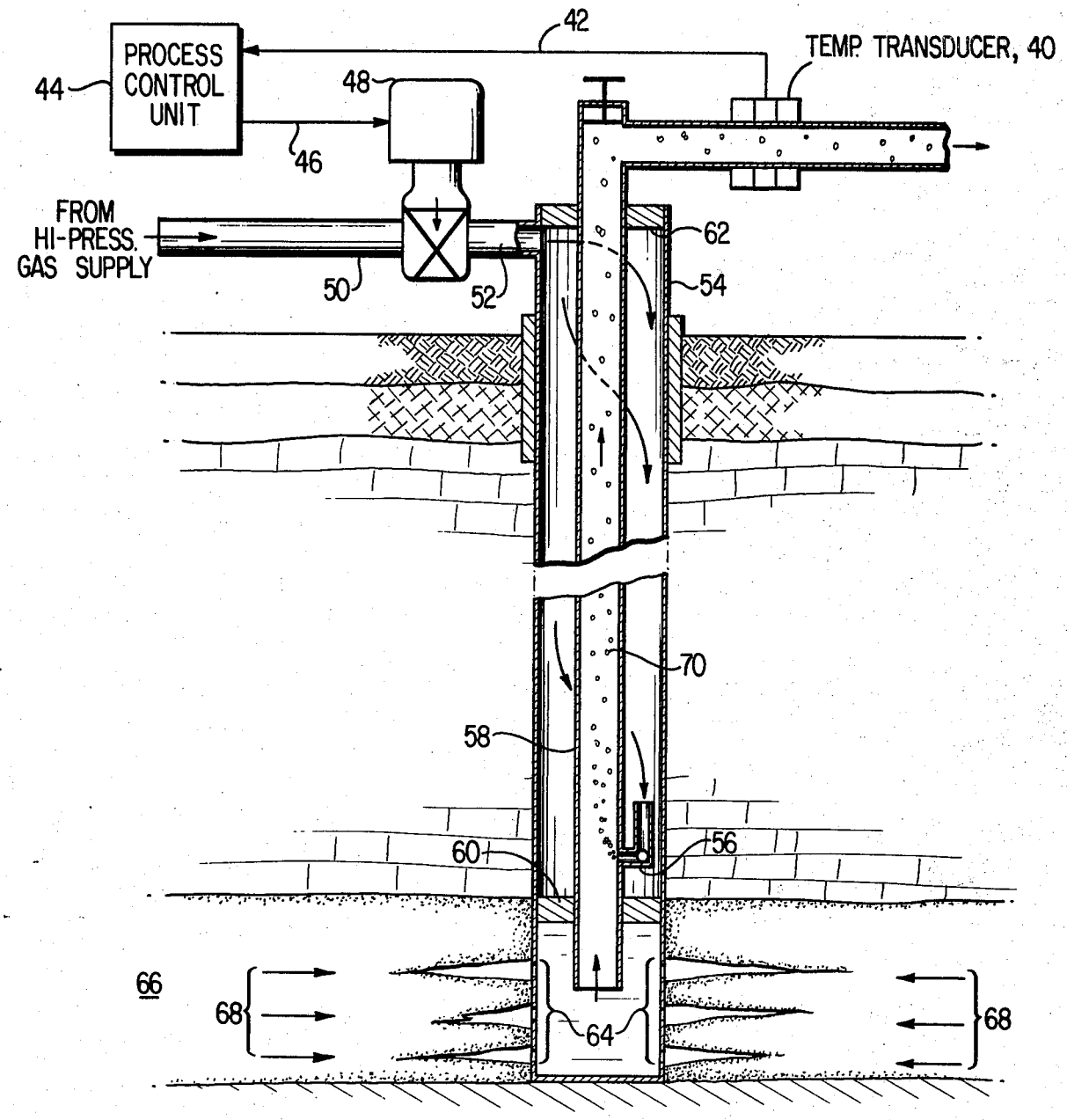
FIG. 3 is a diagrammatic representation of the inventive gas-lift control system for use with a continuous flow gas-lift system.

FIG. 3 shows the inventive gas-lift control system installed in an oil well, which is being produced by means of the continuous gas-lift technique. A temperature transducer or temperature sensor 40 is arranged on the production fluid output line to sense the temperature of the liquid flowing in the line, and not the temperature of the pipe itself. This is necessary in order to prevent ambient conditions from adversely affecting the actual temperature reading of the transducer. The transducer need not be a probe, since it is not necessary to penetrate or protrude into the fluid flow line, but must only sense the temperature of the fluid passing close to the transducer.

The output signal from the transducer 40 is preferably a digital signal and is fed on line 42 to a process control computer 44, which may comprise a microprocessor. This will be described in detail hereinafter. The process control unit 44 operates upon the temperature data on line 42 in accordance with the present inventive method and produce an output signal on line 46, which is fed to a surface control valve unit 48. The surface control valve is the valve in the gas lift system which has as its input the high-pressure gas supply on line 50 and as its output a gas feed line 52 connects to the well casing, shown typically at 54. The surface control valve 48 controls the amount of gas entering into the well, which will be used as the lifting medium for the fluid being produced. The actual valve, which permits the gas to enter the supply tube and become part of the fluid being produced, is shown diagrammatically at 56. This valve serves to communicate the interior of the well casing 54 with the interior of the production tubing 58. Valve 56 is termed generally a gas-lift operating valve and, in the present invention, any type gas-lift valve will work. Nevertheless, in the present embodiment, the preferred type of gas-lift operating valve is the balanced or sliding-sleeve type. This valve is one that opens and closes at the same pressure and, hence, the tubing pressure, i.e., the pressure in the supply tube 58, will have no effect on it.

According to conventional oil-well drilling techniques, the production tube 58 is packed off or sealed in relation to the casing 54 at the bottom 60 and top 62 of the casing 54. The casing 54 is perforated at the bottom, and these perforations are shown generally at 64. The perforated portion of the casing is located in the fluid bearing zone 66 and the arrows 68 indicate that the formation pressure is forcing the fluid into and through the perforations 64 and up the production tube 58. The bubbles or circles 70 in the production tubing 58 indicate that the gas-lift operation is underway. As might be expected, the size of the bubbles 70 increases as the fluid reaches the surface, since the pressure on the fluid is less at the surface than at the fluid bearing zone. The actual operation of the present invention in this continuous gas-lift mode will be explained in more detail hereinbelow.

Figure 4:
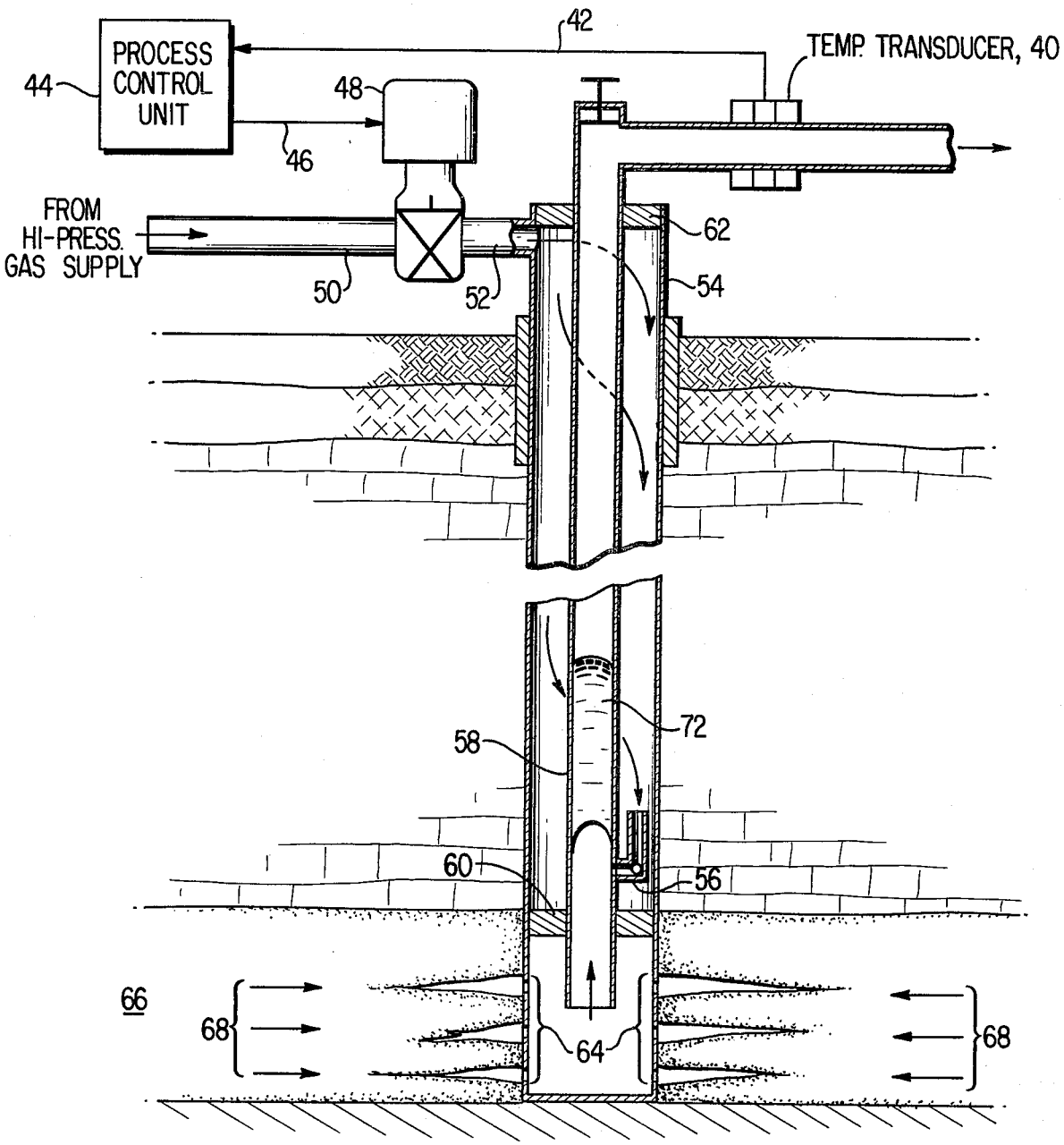
FIG. 4 is a diagrammatic representation of the inventive gas-lift control system for use with an intermittent gas-lift system and showing the beginning of operation of the inventive method.

In FIG. 4, the inventive apparatus is connected to a gas-lift assisted well which is operating under the intermittent method. As indicated above, the intermittent gas-lift technique is also improved upon by the present invention. Generally, the continuous gas-lift technique is utilized in a well, which is a fair producer with its own natural flow, i.e., one which requires only a slight injection of gas to boost the production to the desired level. In other words, the gas lift helps the natural reservoir pressure to be a very good producer. However, the intermittent gas-lift technique is used when a well cannot be produced naturally, i.e., the pressure is not sufficient to cause the well to flow. The intermittent gas-lift technique is also used when it is unfeasible to use a pump or some other device to flow the well.

The intermittent technique involves injecting a large volume of gas into the well, relative to the amount of gas utilized in the continuous gas-lift technique. This large volume of gas creates a bubble under the production liquid and, as the gas bubble expands and flows into the production tubing, the bubble forces the liquid up the production tubing to the surface. FIG. 4 represents the commencing of an intermittent gas-lift cycle. The start of the cycle occurs when the process control unit 44 provides a signal on line 46 to open the surface control valve 48, thereby allowing the high-pressure gas to be passed into and down through the annulus formed between casing 54 and production tubing 58. The gas-lift operating valve 56 then permits the gas to pass into the production tubing 58. It is once again pointed out that the gas being injected is a large volume of gas and not a small quantity, as utilized in the continuous flow gas-lift technique. The large quantity of gas is injected into the production tubing 58 by the gas-lift operating valve 56 and causes a large bubble under the liquid which has already reached some level in the production tubing. The liquid could be 100 feet or 1000 feet below the ground surface. Nevertheless, the gas is injected substantially well below the surface, e.g., at 8000 feet, thus, the liquid 72 above the gas bubble remains in the column and is commonly called a slug, i.e., a slug of liquid. As the gas is injected further, the bubble so formed starts to push the liquid slug 72 upward.

Figure 5:
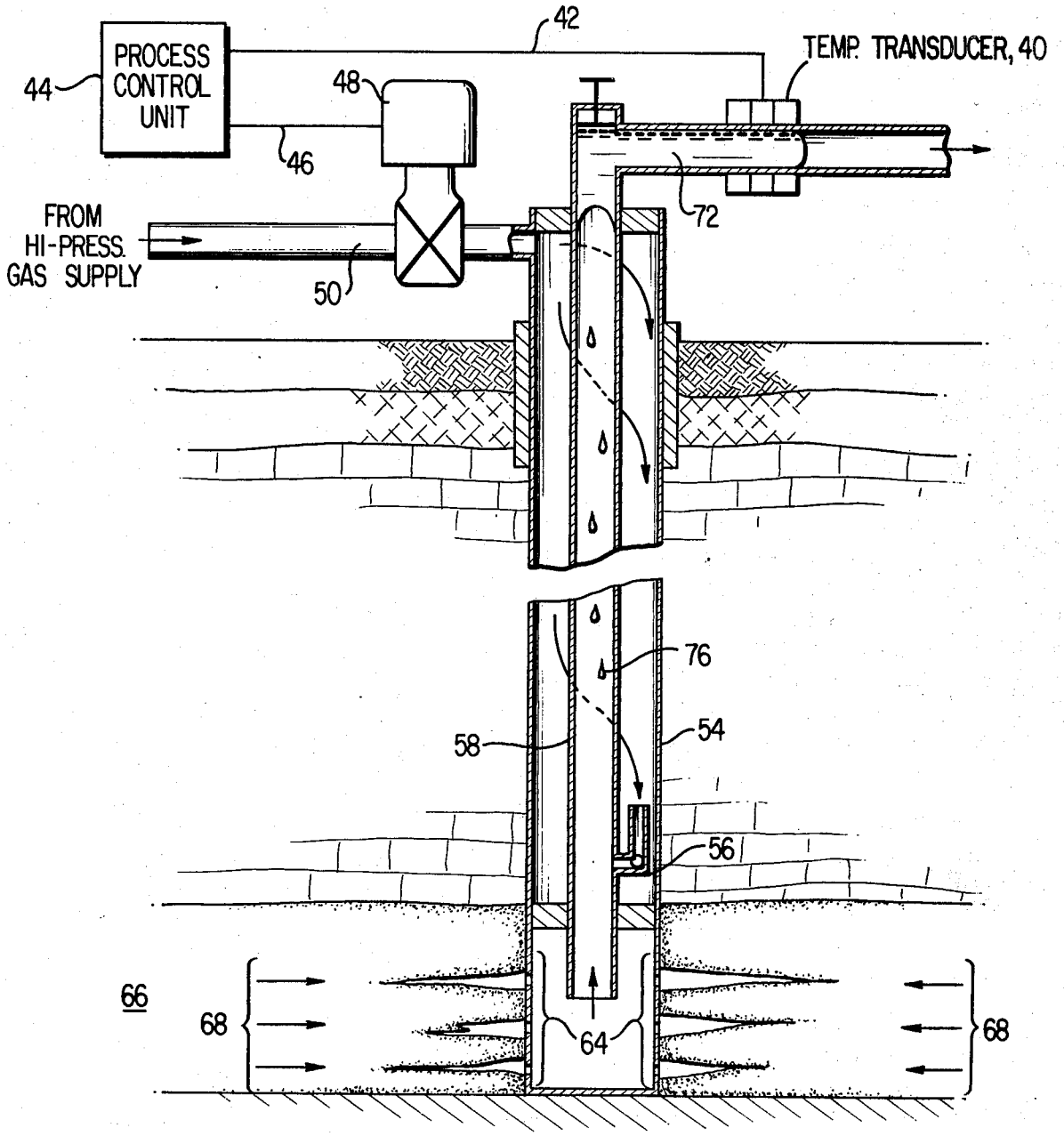
FIG. 5 is a diagrammatic representation of the inventive gas-lift control system for use with an intermittent gas-lift system and showing the final step of the inventive method.

Referring then to FIG. 5, it may be seen that as the gas expands it proceeds up the production tubing and pushes the liquid toward the surface. As seen in FIG. 5, the liquid 72 has risen to the approximate location of the temperature transducer 40. Of course, as the liquid proceeds to the surface it brings its heat with it; however, some of the heat will be lost by conduction on the way to the surface. Additionally, other heat will be lost from the refrigeration effect from the gas being injected into the production tubing 58. As the gas forces the fluid 72 to the surface, some of the fluid will fall back through the gas bubble, and this fallback is represented in FIG. 5 at 76. As the liquid slug 72 passes the temperature transducer 40, the temperature of the liquid slug 72 will be senses and fed on line 42 to the process control unit 44. The process control unit 44 then rapidly monitors and analyzes the temperature of the slug 72, as it passes the temperature transducer 40. Accordingly, the temperature content of the slug 72, and the length of time required for it to pass the temperature transducer 40, are used to determine the volume of liquid passed to the surface by this one intermittent gas-lift cycle.

Referring now back to FIG. 3, the operation of the inventive gas-lift controller will be described in the continuous gas-lift mode. In order to start the inventive system, the operator makes an estimate of the minimum gas injection requirement for the well. In other words, the operator will normally have some expertise in oil-well production, and he will know the problems generally encoutered in the natural production of the well. Hence, he will have some feeling for the gas injection requirements of the well. The gas control valve 48 is manually set to permit this estimated amount of gas to enter the well. It should be noted that any gas injection value will serve to start up the system; however, the better the estimate, the faster the well production will be optimized by the inventive system. The operator then makes an estimate of the maximum cycle time required for the well to react to the injected gas and to stabilize to changes made to the gas control valve at the surface. This value is then entered into the process control unit 44 by means of a keyboard, not shown in FIG. 3. At this time, an initial temperatue measurement of the fluid at the wellhead flow line is made by the temperature transducer 40 and this digital value will be entered into the process control unit 44, by a signal appearing on line 42. Once these initial parameters have been entered into the process control unit, a start switch is actuated and the cycle time, as estimated above, begins to count down to zero.

When the cycle time countdown has reached zero, the microprocessor, which forms a part of the process control unit 44, reads the new temperature in the flow line at the wellhead by an input from the temperature transducer 40. This new temperature is stored and compared with the original temperature value, which had previously been stored in the microprocessor. The microprocessor then determines if the last adjustment to the gas control valve caused an increase or a decrease in the temperature of the contents of the flow line at the wellhead. If the temperature has increased, a change to the setting of the surface control valve 48 is made in the same direction as the previous change. The magnitude of the change made to the setting of the control valve 48 is based upon the amount of temperature difference between the two temperature values under comparison. For example, if the previous change to the surface control valve 48 reduced the amount of gas being injected into the well, and the temperature change was in the same direction as the previous change, the new signal on line 46 to the surface control valve will also reduce the amount of gas being injected into the well.

If the temperature of the liquid in the flow line has decreased, then the change to the setting of the control valve 48 will be in the reverse direction from the previous change. For example, if the previous change in valve setting increased the gas injected into the well, and the temperature at the flow line decreased, then the new command on line 46 to the control surface valve 48 will be to decrease the gas injected into the well. As might be expected, when this situation occurs, the control valve setting is usually quite close to the optimum setting, which corresponds to the peak temperature on the curve of FIG. 2.

In any event, the microprocessor in the process control unit 44 sends a signal on line 46 to the surface control valve 48 which causes the valve to be adjusted to the newly calculated setting. This information is retained in the memory portion of the process control unit and then the countdown cycle is initiated once again. Once the countdown cycle reaches zero, the temperature transducer 40 is monitored by the process control unit 44 and the inventive method begins once again.

Figure 6:
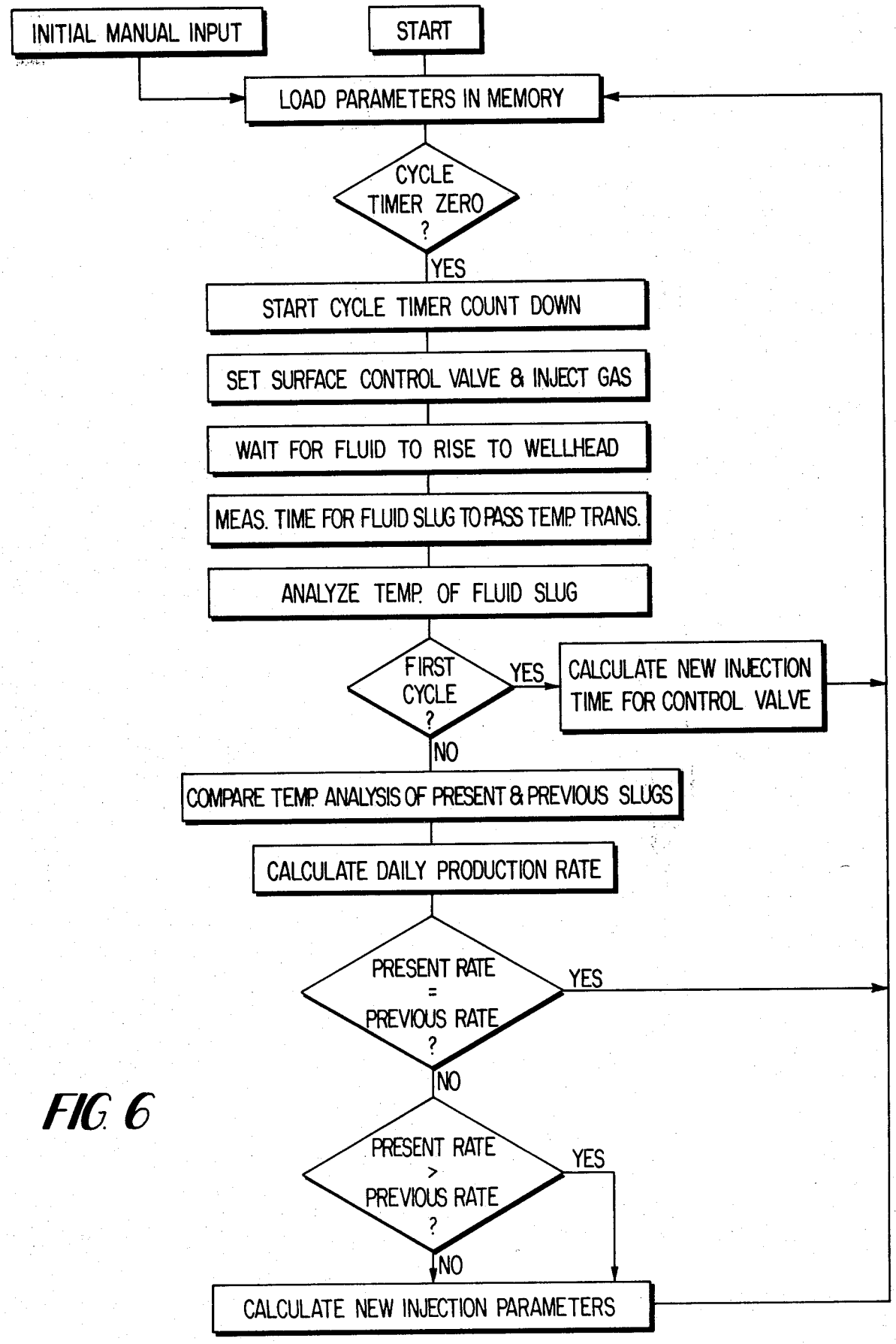
FIG. 6 is a flow chart of the inventive method.

Referring now to FIG. 6, a flow chart representing one manner of practicing the inventive method in the intermittent gas-lift mode is set forth. As seen in FIG. 6, the startup is commenced by inputting the initial gas lift parameters into the memory of the microprocessor. These initial parameters include the cycle time and injection time. The first step is to start the cycle timer, and then to inject the gas into the annulus with the control valve setting at its initial estimate and with the initial injection time. It should be noted that in the intermittent mode, the control valve 48 will be opened for a predetermined length of time which controls the extent of the gas formed behind the slug. Then there is a waiting period, which corresponds to the time necessary for the slug, shown at 70 in FIG. 4, to begin rising to the surface. The temperature transducer 40 detects the start of the slug by the change in line temperature and then records and anlyzes the temperatures and the length of time required for the slug to pass the temperature transducer. If this is the first cycle of the inventive method, the microprocessor calculates a new injection time for the second cycle, which is intended to optimize the production of the well. The slug analysis and the newly calculated parameters are then placed in the memory section of the microprocessor and the cycle timer is permitted to run to zero. During this time, the production tubing is filling with another slug of liquid. As seen in FIG. 6, when the cycle timer runs out, the cycle timer is restarted and a new injection of gas is made to the well, for the length of time as calculated in the first cycle; the waiting period is permitted to expire while the next slug rises to the surface. Going through the loop for the second time, the temperature transducer again detects the start of the slug and records the length of time that the slug of liquid takes to pass, the various temperatures along the length of the slug are recorded and analyzed in the process control unit. The temperature analysis of the slug is then compared with the prior analysis made of the previous slug temperatures and it is then possible to calculate the daily production rate, based on the repetition rate and slug contents. Following procedures similar to those outlined in relation to the continous gas-lift method, the new gas injection time and cycle times may be calculated. This information is stored and the waiting period is continued until the cycle timer runs out, which permits the production tubing to fill once again with liquid. At such time, the cycle timer is restarted and the loop is run once again.

Figure 7:
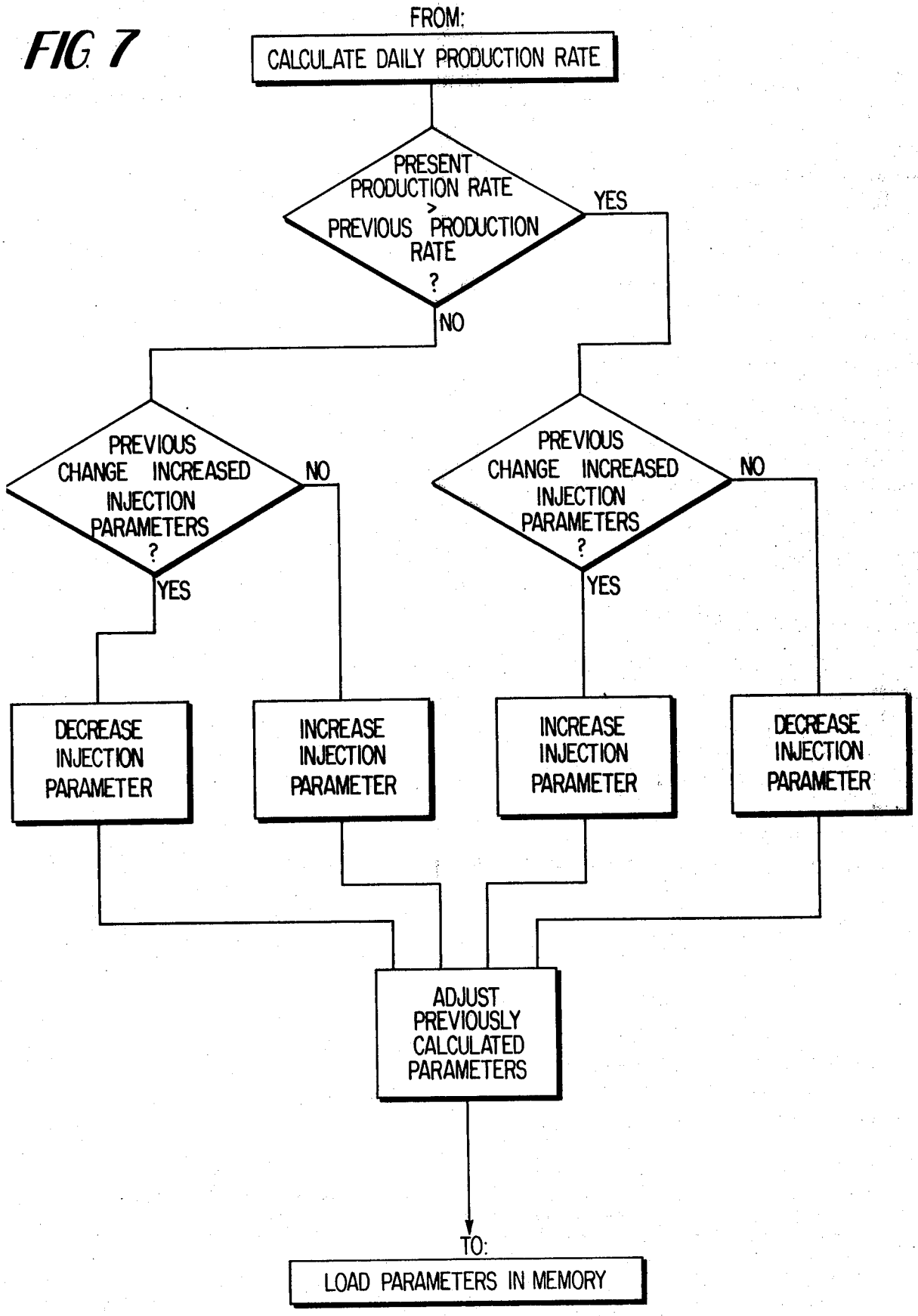
FIG. 7 is a flow chart showing a detailed step of the inventive method.

The control of the gas injection valve in the above method is quite similar to that in the continuous mode, and this is shown in FIG. 7. As seen in FIG. 7, if the present production rate is greater than the preceding production rate, and the previous change in the injection parameter was to increase them, then the new changes will be in the same direction. In other words, if the previous change was to increase the injection parameter, then the newly calculated value will be a further increase in that parameter. Whereas, if the previous change was to decrease the injection parameter, then the newly calculated value will be to further reduce that parameter. This is shown in the flow chart of FIG. 7.

Similarly, if the present production rate has decreased from the previous production rate, then the changes to the surface control valve will be in the reverse direction. In other words, if the previous change was to increase an injection parameter, then the newly calculated value will be to decrease that parameter value. Whereas, if the previous change was to decrease the injection parameter, then the newly calculated value will be based on an increase to that parameter value. Thus, it may be seen that, calculation of the new gas injection parameters are made only after the second loop through the inventive method, since some basis for calculation must be obtained. Upon the calculation of the new gas injection parameters, the loop is repeated once again for each cycle of the intermittent gas assisted production lift. If the production rates are equal, then the inventive method has run its course, and the well is continued to be produced with those parameters. However, upon each pass through the loop, the cycle time and/or injection time will be adjusted to optimize the performance of the production of the well until the peak of the temperature curve is obtained. This temperature curve was shown in FIG. 2.

Figure 8:
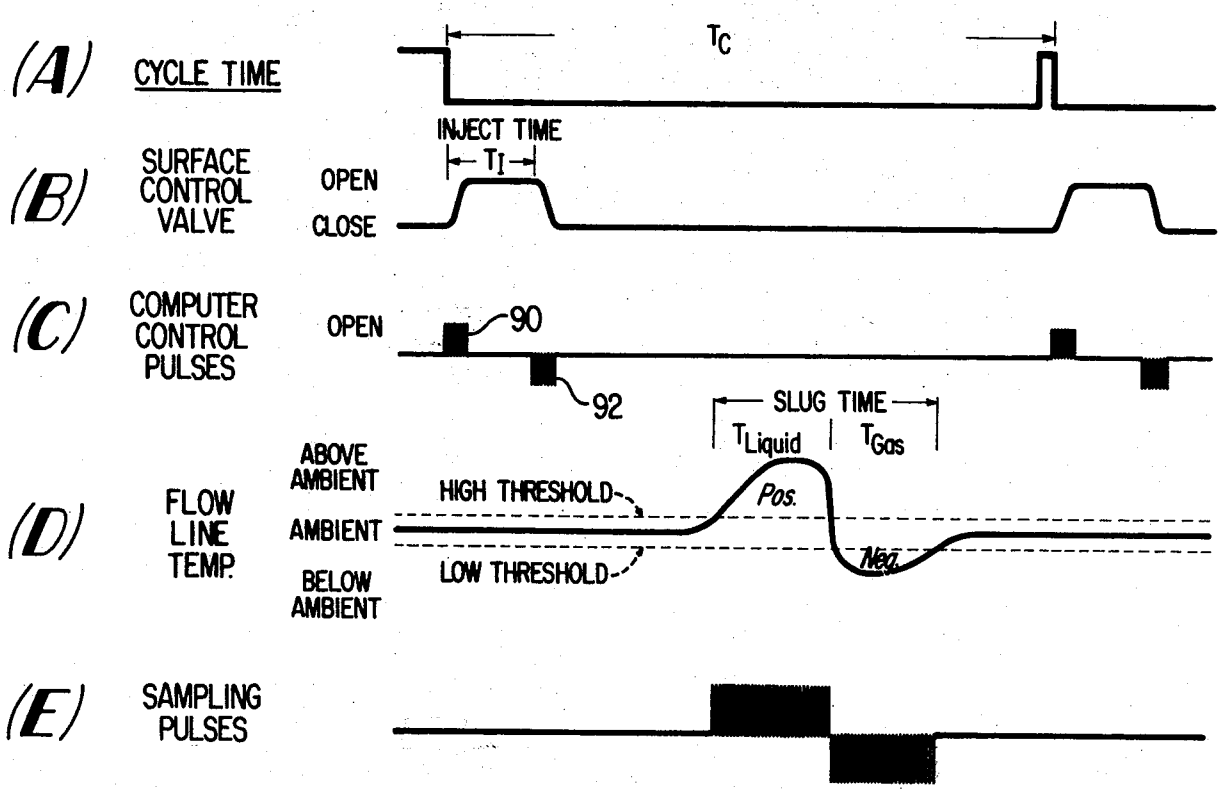
FIGS. 8A–8E are graphs showing the timing operation of the inventive gas-lift control system.

FIGS. 8A–8E show the wave forms relative to the timing of the intermittent gas-lift method described above. FIG. 8A shows the cycle timer, which is the output of the process control computer 44 on line 46 fed to the surface control valve 48. This signal opens the surface control valve, as shown in FIG. 8B. The injection time is shown in FIG. 8B as $T_i$. This period is initially preset and is then ultimately determined by the process control computer 44. The duration of this injection time corresponds to the length of the gas bubble which is created in the production tubing beneath the liquid slug. There then follows a period of time wherein the entire system must wait for the liquid slug to reach the well surface. FIG. 8C shows the commands produced by the process control computer fed to the surface control valve which include pulses, shown typically at 90, serving to open the surface control valve and pulses, shown typically at 92, serving to close the surface control valve. FIG. 8D shows the temperature in the production line, as sensed by the temperature tranducer 40. This analog curve shows the actual response of the temperature transducer 40. Of course, this signal is digitized before it can be employed by the microprocessor.

The present invention provides a high threshold and a low threshold, which sets the sensitivity of the process control computer, so that small variations occurring around the ambient temperature are not incorporated into the control system. This simply requires a temperature to be above the high threshold and below the low threshold before any corrections to the various parameters are made.

Referring then to FIG. 8D, as the slug of liquid gets to the temperature transducer the temperature rises rapidly. The temperature goes to a maximum value and remains constant until the liquid slug passes the transducer, at which time the temperature will drop rapidly. This temperature drop is often below the ambient temperature due to the refrigeration effect of the gas bubble behind the liquid slug. Since flow has stopped, the temperature will slowly return to ambient.

Because it is necessary to monitor the temperatures sensed by the temperature transducer, the process control computer samples discrete points during the time that the slug is in registry with the transducer and also for the time following that when the temperature has dipped below the ambient. The sampling pulses are shown in FIG. 8E.

The present invention recognizes that the information relating to the temperature dropping below the ambient temperature is quite important. This is so because it has been found that it is desirable to minimize the negative swing of the temperature, since this indicates that an excess of gas is required to force the slug up the production tubing to the surface. Since the volume of gas injected is known, it is quite simple for the process control computer to compare this volume of gas with the liquid produced and, hence, it is possible to adjust the cycle time and injection time to an optimum point. It is at this point that the well can be operated to produce the maximum fluid for the minimum amount of gas injected per day.

The problem solved by the present invention in the intermittent gas-lift well is how to inject the right amount of gas in a cycle and also how to provide the proper cycle time. In order to optimize production in an intermittent gas-lift well, it is necessary to optimize the number of slugs of liquid which may be picked up in one day and to attempt to standardize the size of the slugs. In other words, if you start the gas-lift too quickly and provide too many slugs too quickly, the liquid will not be permitted to fill into the production tubing from the formation and the size of the slug will be reduced.

Therefore, the inventive method causes the process control computer to monitor these fluid slugs as they come to the surface and to make the necessary changes regarding injecting more or less gas into the well to reach the maximum velocity of lift necessary to maximize the production in a single slug. At the same time, the inventive method reduces the negative swing of the temperature curve, as seen in FIG. 8D.

Figure 9:
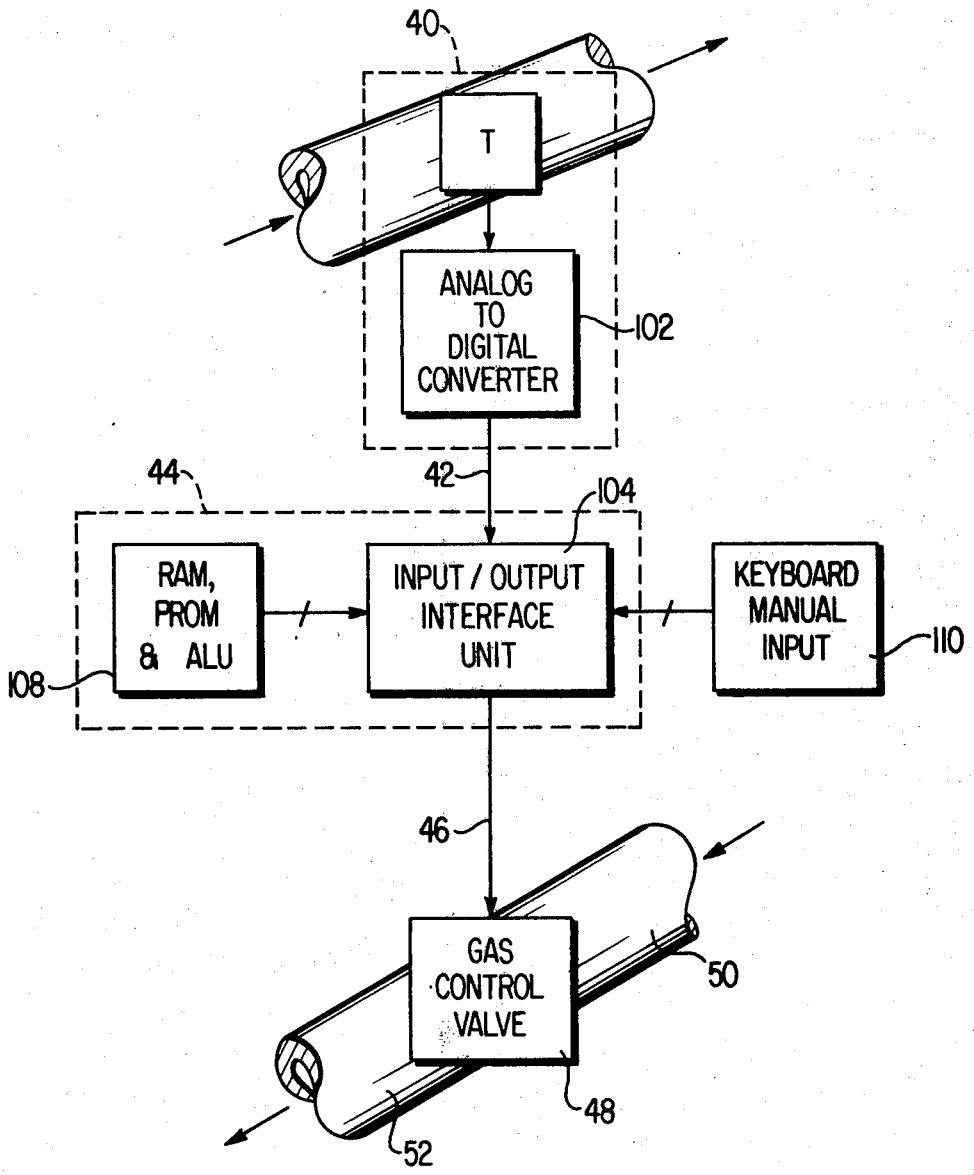
FIG. 9 is a block diagram of the inventive apparatus.

FIG. 9 shows the several elements of the inventive system and the manner in which they are connected. More specifically, the temperature sensing portion 100 of transducer 40 is connected to an analog-to-digital converter 102 to digitize the temperature signals so that it may be utilized by the microprocessor. An input/output unit 104 of the conventional type is employed to communicate with the memory and arithmetic logic units 108 of the microprocessor. The microprocessor may be of a conventional type employing a read/write or RAM memory to receive the various parameters and data. The program embodying the inventive method may be burned into the PROM of the microprocessor in the conventional manner. A manual keyboard 110 is provided to initiate the program startup and also to insert initial parameters. The actual control of the gas-lift system is performed by the gas surface control valve 48 by signals on line 46.

It is understood, of course, that the foregoing description is presented by way of example only and is not intended to limit the scope of the present invention, except as set forth in the appended claims.

What I claim is:

1. A method for controlling production of an oil well being artificially produced by the gas-lift technique, said method comprising the steps of:

setting a surface located injection gas control valve to a first setting;

injecting an amount of gas into the production tubing of the well;

detecting continuously the temperatures at the wellhead of the fluid produced by the injected gas;

storing the temperatures detected during a first time period in a recallable memory;

storing the temperatures detected during a second time period in the recallable memory;

comparing the first time period temperatures with the second time period temperatures;

adjusting control valve to a different setting based on the comparison of temperatures;

storing temperatures during a subsequent time period;

comparing presently stored temperatures with temperatures stored immediately preceding the presently stored temperatures;

determining if previous adjustment to control valve increased or decreased temperatures at wellhead;

adjusting control valve according to predetermined relationship between direction of adjustment of control valve and increase or decrease of wellhead temperature; and controlling the production of the oil well by repeating the steps of storing subsequent temperatures, comparing present and preceding temperatures, determining temperature measures and adjusting the control valve.

2. The method of claim 1, wherein the step of adjusting the control valve according to a predetermined relationship comprises the further steps of:

adjusting the control valve setting in the same direction as the previous adjustment if the temperature determination indicates an increase in temperature; and adjusting the control valve setting in the reverse direction from the previous setting if the temperature determination indicates a decrease in temperature.

3. Apparatus for controlling production of an oil well being artificially produced by the use of injected gas fed to a gas lift operating valve, said apparatus comprising:

temperature transducer means arranged adjacent the oil well production tubing at the wellhead for producing an output signal representing the temperature of the fluid in the production tubing, said temperature transducer means including an analog to digital convertor for producing a digital output signal representing the temperature of the fluid at a wellhead;

process control means connected to receive the output signal from said temperature transducer means for analyzing said output signal and producing a control signal;

a gas control valve arranged in the injection gas supply line and connected to receive said control signal, whereby said control valve controls the rate and timing of gas being injected into the oil well in response to the temperature at the wellhead of the fluid being produced.

4. Apparatus for controlling production of an oil well being artificially produced by the use of injected gas fed to a gas lift operating valve, said apparatus comprising:

temperature transducer means arranged adjacent the oil well production tubing at the wellhead for producing an output signal representing the temperature of the fluid in the production tubing;

process control means connected to receive the output signal from said temperature transducer means for analyzing said output signal and producing a control signal, said process control means comprising a microprocessor including an input/output interface device for receiving said temperature transducer means output signal and outputting said control signal, and a memory section having a programmable read only memory containing an algorithm for analyzing and producing said control signal;

a gas control valve arranged in the injection gas supply line and connected to receive said control signal, whereby said control valve controls the rate and timing of gas being injected into the oil well in response to the temperature at the wellhead of the fluid being produced.

5. Apparatus for controlling production of an oil well being artificially produced by the use of injected gas fed to a gas lift operating valve, said apparatus comprising:

temperature transducer means arranged adjacent the oil well production tubing at the wellhead for producing an output signal representing the temperature of the fluid in the production tubing;

process control means connected to receive the output signal from said temperature transducer means for analyzing said output signal and producing a control signal;

a gas control valve arranged in the injection gas supply line and connected to receive said control signal, whereby said control valve controls the rate and timing of gas being injected into the oil well in response to the temperature at the wellhead of the fluid being produced; and a gas lift operating valve within the oil well, said gas lift operating valve comprising a balanced valve having a variable port which is not influenced by the pressures inside said oil well not attributed to the injected gas.

6. The apparatus of claim 5, wherein said algorithm in said microprocessor is based on determining if the wellhead fluid temperature has increased or decreased, and providing a control signal to command an adjustment of said gas control valve in the same direction as the previous adjustment of the wellhead fluid has increased in temperature and providing an adjustment which is in the reverse direction if the wellhead fluid temperature has decreased in temperature.

7. A method for controlling production of an oil well being artificially produced by the injected gas, gas-lift technique, said method comprising the steps of:

detecting at the wellhead the temperature of the fluid produced by the injected gas;

sampling at successive intervals the temperatures detected;

comparing the temperatures in a first sampling interval with the temperatures in a second sampling interval;

altering the amount of gas being injected based on the comparison of temperatures in successive sampling intervals;

comparing current temperature samples with temperatures sampled immediately preceding the alteration of the amount of gas being injected;

determining if alteration to amount of gas being injected increased or decreased the wellhead temperatures in the current sample;

altering the amount of gas being injected according to a predetermined relationship between the direction of preceding alteration of gas being injected and increase or decrease of wellhead fluid temperature; and repeating the steps of sampling at successive intervals, comparing current and preceding temperature samples, determining temperature increases or decreases, and altering the amount of gas being injected.

8. The method of claim 7, wherein the step of altering the amount of gas being injected according to a predetermined relationship comprises the further steps of:

altering the amount of gas being injected in the same direction as the previous alteration if the temperature comparison indicates an increase in temperature at the wellhead; and altering the amount of gas in the reverse direction from the previous alteration if the temperature comparison indicates a decrease in temperature at the wellhead.

9. A method of improving the production of an oil well, comprising the steps of:

injecting a pressurized gas into the production tubing by the gas-lift technique; and controlling the rate of injection of the gas based upon a predetermined relationship between the rate of injecting the gas and the monitored temperature of the liquid produced at the wellhead.

10. The method of claim 9, wherein the step of injecting pressurized gas into the production tubing is performed in a continuous manner, whereby pressurized gas is continuously injected into the production tubing.

11. The method of claim 9, wherein the step of injecting pressurized gas into the production tubing is performed in an intermittent manner, including the alternately successive steps of injecting a pressurized gas for a predetermined period of time, then interrupting the gas injection for a period of time sufficient to permit the liquid being produced to rise to the wellhead.

12. Apparatus for improving the production of an oil well, comprising:

injecting means for injecting a pressurized gas into the production tubing by the gas-lift technique; and controlling means for controlling the rate of injection of the gas based upon a predetermined relationship between the rate of injecting the gas and the monitored temperature of the liquid produced at the wellhead.

13. The apparatus of claim 12, wherein said injecting means comprises means for injecting pressurized gas into the production tubing in a continuous manner.

14. The apparatus of claim 12, wherein said injecting means comprises means for injecting pressurized gas into the production tubing in an intermittent manner.

15. The apparatus of claim 14, wherein said means for injecting the gas in an intermittent manner comprises means for alternately and successively injecting a pressurized gas for a predetermined period of time, and then interrupting the gas injection for a period of time sufficient to permit the liquid being produced to rise to the wellhead.

16. An improved apparatus for controlling production of an oil well including production tubing means extendible from a wellhead into the fluid bearing zone of the ground for transporting fluid from the fluid bearing zone to the wellhead, and gas injection means for injecting gas into the production tubing to increase the production of the well, wherein the improvement comprises:

temperature transducer means for producing an output signal representing the temperature of the fluid in the production tubing at the wellhead;

process control means coupled with said temperature transducer means for receiving the output signal, analyzing the output signal, and producing a control signal for controlling the rate and timing of gas being injected into the production tubing in dependence on the temperature of the fluid at the wellhead; and gas control valve means included within said gas injection means, said gas control valve means coupled with said process control means for receiving, and responding to, said control signal, whereby said gas control valve means controls the gas being injected into the production tubing.

* * * * *